US007296352B2

(12) United States Patent
Alulis et al.

(10) Patent No.: US 7,296,352 B2
(45) Date of Patent: Nov. 20, 2007

(54) METHOD OF MANUFACTURING RECLOSABLE RING

(75) Inventors: Paul F. Alulis, Valley Forge, PA (US); Gena Alulis, Valley Forge, PA (US); Eric B. Alulis, Philadelphia, PA (US)

(73) Assignee: Superfit, Inc., King of Prussia, PA (US)

( * ) Notice: Subject to any disclaimer, the term of this patent is extended or adjusted under 35 U.S.C. 154(b) by 527 days.

(21) Appl. No.: 10/935,298

(22) Filed: Sep. 7, 2004

(65) Prior Publication Data

US 2006/0048357 A1 Mar. 9, 2006

(51) Int. Cl.
*A44C 27/00* (2006.01)

(52) U.S. Cl. ..... 29/896.42; 29/896.412

(58) Field of Classification Search ..... 29/8, 29/896.412, 896.4, 525.14; 63/7, 15.7; 24/650
See application file for complete search history.

(56) References Cited

U.S. PATENT DOCUMENTS

| | | | | |
|---|---|---|---|---|
| 945,107 | A | | 1/1910 | Moodey |
| 3,221,514 | A | | 12/1965 | Newman |
| 3,561,521 | A | | 2/1971 | Reneer |
| 4,013,259 | A | | 3/1977 | Tryon |
| 4,991,409 | A | | 2/1991 | Creates |
| 5,136,858 | A | | 8/1992 | Bruner |
| 5,362,282 | A | * | 11/1994 | Lickton ..... 474/220 |
| 5,801,351 | A | * | 9/1998 | Ecoffet et al. ..... 219/52 |
| 6,125,657 | A | | 10/2000 | Esposito |
| 6,370,914 | B1 | | 4/2002 | Bruner |
| 6,412,304 | B1 | | 7/2002 | Adelman |
| 6,748,764 | B1 | | 6/2004 | Roemer |

FOREIGN PATENT DOCUMENTS

GB 002066137 A 7/1981

OTHER PUBLICATIONS

Shanahan, J. in a New Light Faster, more efficient laser welders are shedding new light on jewelry manufacturing. AJM Magazine, Dec. 2003, whole document, pp. 1-48.

Crafford, J. E. G. Making Soldering a Technique of the Past. Precision Product Co. (CCP) 220, whole document. pp. 1-6; 37-42.

* cited by examiner

*Primary Examiner*—John C Hong
(74) *Attorney, Agent, or Firm*—Garcia-Zamor IP Law; Ruy M. Garcia-Zamor

(57) ABSTRACT

An improved recloseable ring and a method of manufacturing thereof.

16 Claims, 12 Drawing Sheets

FIG. 1
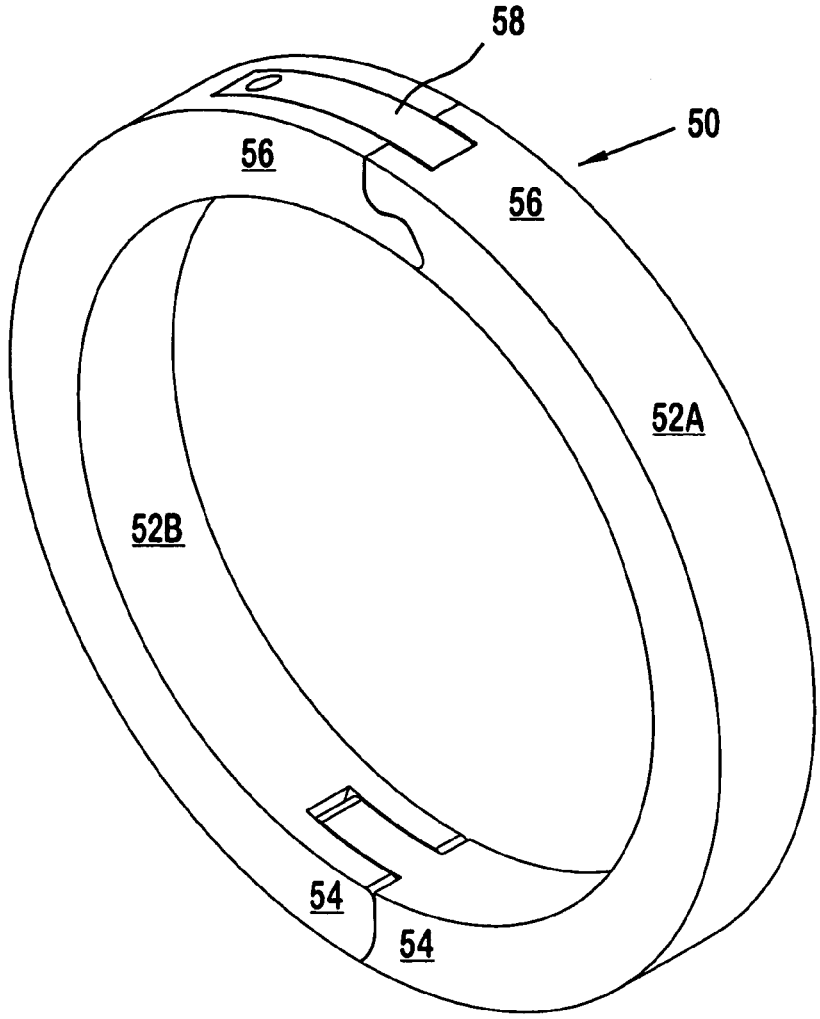
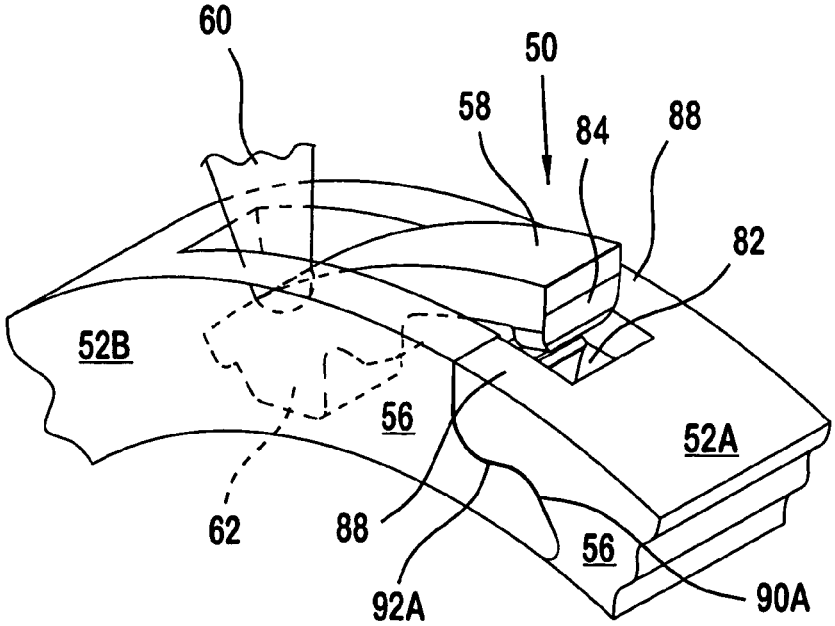
FIG. 2

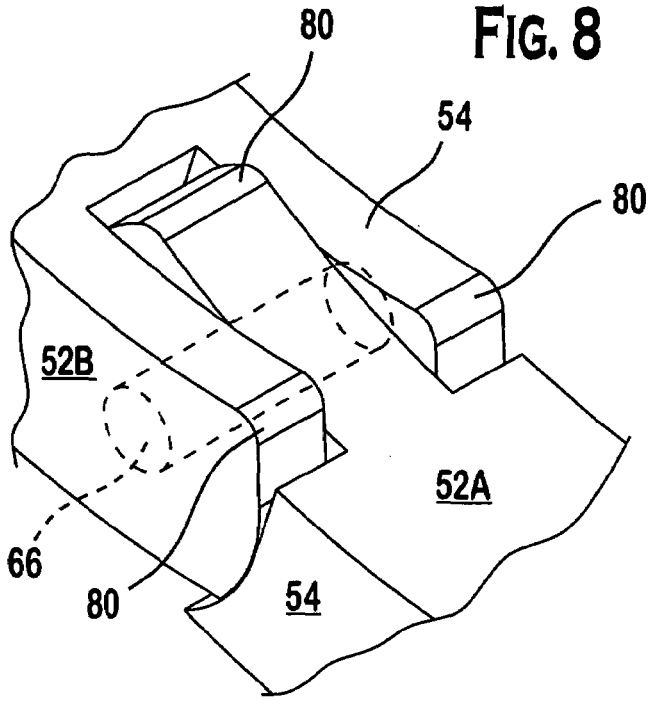
FIG. 8
FIG. 9A
(PRIOR ART)
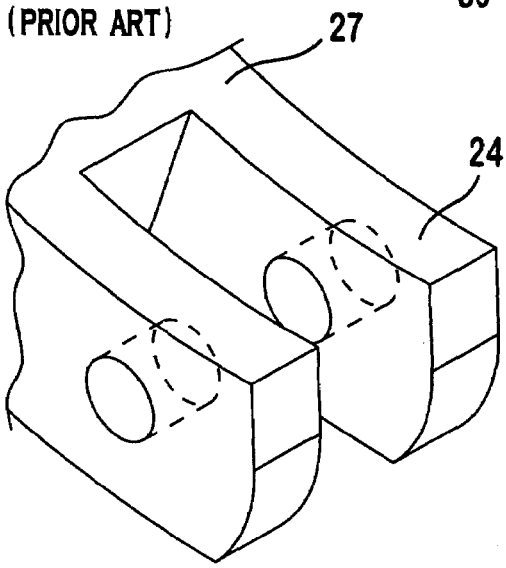
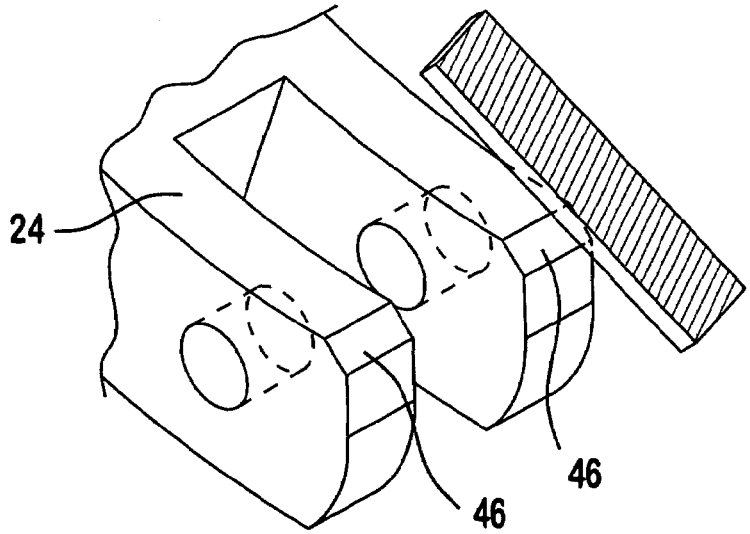
FIG. 9B
(PRIOR ART)

METHOD OF MANUFACTURING RECLOSABLE RING

BACKGROUND

The present invention is generally directed to recloseable rings and, more specifically, to an improved recloseable ring and a method of manufacture thereof.

Recloseable rings generally include two shank portions that are detachably connected to allow placement of the recloseable ring on a finger without necessitating that the ring slide over the length of a finger for proper positioning. A ring wearer can sometimes encounter difficulty properly positioning a ring on his or her finger due to relatively large knuckle size and increases in finger size due to stress, medications, pregnancy, or the like. Recloseable rings are designed to provide a custom fit that obviates the above problems.

Conventional recloseable rings require significant highly skilled manual labor due to numerous handcrafting steps that need to be performed by accomplished jewelers. Typically, such rings are manufactured using molds that are used to injection mold ring component pieces that are then used for casting portions of conventional recloseable rings. Once the portions of the recloseable ring are cast, numerous precision manual adjustments and processes must be performed by highly skilled jewelers.

Referring to FIGS. 6A-6C, the molds used for conventional recloseable rings are designed to create a mound of metal 20 which surrounds a latch pin hole 22 on an end of one of the ring shank portions 24 that supports a latch 28. Once the pin 26 is inserted into the hole and through the latch during the assembly process, the ring shank portion 24 and latch 28 are taken to a riveting machine (not shown), carefully lined up and clamped into position. The proper positioning and clamping of a delicate high-end jewelry piece is painstaking, time consuming work for a jeweler.

The jeweler then has to carefully lower the rivet machine bit over the mound of metal 20 that surrounds the pin 26 and push the metal 20 over the top of the pin. Referring specifically to FIG. 6B, when the hole 22 was covered, the shank portion 24 and latch 28 were removed from the clamp. Referring to FIG. 6C, any excess metal was then polished smooth to form a pleasing aesthetic look. However, this manufacturing process is problematic in that the jeweler can never be sure precisely how much metal 30 remains to cover the latch pin after polishing. This results in ring wearers experiencing breakdowns and requiring repairs that are expensive for the wearer and damaging to the reputation of the ring manufacturer.

Referring to FIGS. 9C-9F, the conventional recloseable ring also requires two additional riveting operations to hingeably connect the two ring shank portions. The hinge pin 32 is secured within the hinge pin hole 34 without any mounds of metal 20 being pre-formed on the hinge ends of the shank portions. Referring specifically to FIG. 9C, the hinge pin 32 is inserted into the hinge pin hole 34 and extends outwardly on both sides of the connected ring shank portions. The extra length of the pin 32 is then used to fill the gaps between the outer shank portion walls and the pin to secure the hinge pin 32 into position. Referring to FIG. 9D, the two shank portions 24 and the hinge pin 32 are taken to the riveting machine, lined up, and clamped into position. Then, the riveting machine compresses a first end of the hinge pin 32 to fill the corresponding gap. Then, referring to FIG. 9E, the two ring shank portions 24 and the hinge pin 32 are removed from the riveting machine, reversed in position, painstakingly repositioned in the machine, lined up, and clamped in place. Then, the press is lowered onto the remaining protruding portion of the hinge pin 32 to force the excess metal to spread out and fill the remaining gap. Then it is necessary to manually polish both sides of the ring to eliminate any blemishes created by the filling of the gaps between the hinge pin and the outer shank portion walls.

Accordingly, the riveting process for conventional recloseable rings must be performed three times. It is inefficient, time consuming, and creates troublesome inconsistencies in the finished product. The hinge holes and latch holes are often not completely filled, not secured, and can be unsightly as a jewelry product.

Another problem with conventional recloseable rings is that the latches used to secure the ring are generally thin and weak. A thin latch is inadequate for normal daily wear and is one of the most common reasons for the return of a recloseable ring. During the normal process of filing and polishing the shank portions 24, a bench jeweler often removes too much metal from the latch, thinning it further and causing it to bend easily. This results in the latch being defective. One solution has been to make the overall ring generally thicker to allow the latch to also be thicker. While this somewhat addresses the problem of a defective latch, it results in a bulkier and less attractive recloseable ring.

Conventional recloseable rings also require a significant depression of a free end of the latch to release the latch to remove the ring. This significant depression distance detracts from the convenience and operability of the ring.

Referring to FIG. 12, conventional recloseable rings include a shank portion 24 defining a cavity 38 to receive a head 40 of the latch 28. The cavity 38 is generally formed by opposing side walls 42 and a base 44. The opposing side walls intersect the base 44 at a ninety (90°) degree angle which requires that the connection area 43 between the base 44 and the opposing side walls 42 be sufficiently large to avoid separation during injection molding of the piece used to form the shank portion. This minimizes the size of the latch head 40 which limits the thickness of the latch and therefore weakens the latch connection of conventional recloseable rings.

Referring to FIG. 9B, conventional recloseable rings also require the filing of shank portion edges 46 proximate to the hinge ends thereof to reduce the incidence of scratching or catching of any loose finger skin when the ring is put on. The filing and polishing of the edges 46 is a time consuming and delicate process that must be performed by a jeweler that results in inconsistencies between rings.

The molds for forming the ring component pieces for conventional recloseable rings are manufactured on an individual basis. During the manufacture of the molds, each mold is modified based on intuition from a prior mold(s) which results in no consistency between the molds. Each mold is only capable of producing a single shank portion which makes production even more costly. As this is the only known way of using injection molding to manufacturer recloseable rings, any shrinkage of the material used to form the ring component pieces during the manufacturing process results in each component of the finished ring needing significant adjustment to properly assemble a suitable recloseable ring. Accordingly, each ring requires varying amounts of corrective labor depending upon the molds that were used to make the desired ring. Correcting the actual size of the ring components requires that the ring shank portions are manually inserted into a rolling mill and stretched to size. This causes the rings to twist and torque which reduces the effective alignment between the ring shank portions when assembled. In some cases, it is necessary to manually place the conventional ring shank portions in a bench vice so that a jeweler can carefully judge how much pressure is necessary to straighten each piece. The correction of the sizing of ring shank portions manufactured using the individual molds is delicate, time consuming work that requires a highly skilled jeweler.

Conventional recloseable rings use a "one size fits all" latch to accommodate various ring sizes. To create a proper fit for the latch, it is necessary to bend and fit the latch for each ring. This is a delicate, time consuming process for a jeweler that results in a high number of rejects. When the latch must be shortened, and too much excess latch material is removed, a ring will not function properly and must be scrapped.

As should be apparent from the above, conventional recloseable rings require significant, expensive, highly skilled manual labor by expert jewelers to produce a superior product. It would be advantageous to provide an improved recloseable ring and method of manufacture thereof that reduces the amount of skill and manual labor necessary to manufacture a satisfactory product; that provides a thicker latch without a corresponding increase in thickness of the overall ring; that eliminates many of the polishing steps; that eliminates the multiple excruciating uses of the rivet machine; that reduces the occurrence of pinched skin when placing the recloseable ring over a finger; that provides for uniform molds across all ring sizes; that allows the ring component pieces used to form both halves of the ring to be formed by a single injection molding operation; and/or that eliminates the "one size fits all" latch used in conventional recloseable rings.

SUMMARY

Briefly speaking, one embodiment of the present invention is directed to a method of forming a recloseable ring. The method includes: providing first and second shank portions, each having a hinge end; aligning the hinge end of the first and second shank portions so that the first and second shank portions combine to form a bore adapted to receive a hinge pin, one of the first and second shank portions defining an opening to the bore; inserting the hinge pin into the bore; and laser welding the hinge pin to a portion of the bore such that the first and second shank portions are pivotably connected by the hinge pin.

A separate embodiment of the present invention is directed to a method of making a recloseable ring having a thicker latch than conventional recloseable rings without having to increase an overall thickness of the recloseable ring. The method includes: providing a shank portion having a latch end comprising a base and opposing sidewalls which combine to define a cavity configured to receive a head of a latch when the recloseable ring is secured in a closed position, the cavity being configured such that a radial cross section has a generally U-shape comprising two radiused corners each generally located between a separate one of the opposing walls and the base, the radiused corners adding strength to the connection between the base and the opposing sidewalls to allow the cavity to be deeper, relative to conventional recloseable rings, to allow for the head to be larger, relative to conventional recloseable rings, without increasing the overall radial thickness of the recloseable ring.

A separate embodiment of the present invention is directed to a method of forming a recloseable ring with reduced manual manufacturing steps. The method includes: forming first and second shank portions each having a hinge end, wherein the first and second shank portions are formed with a taper proximate the hinge end, without the taper being substantially formed by a manual adjustment process, wherein the taper reduces the instances of pinching by the first and second shank portions during the closing of the ring.

A separate embodiment of the present invention is directed to a method of providing coordinated latches for various ring sizes for a recloseable ring of a given thickness. The method includes dividing a given range of recloseable ring sizes into upper and lower ranges; providing a separate latch for each of the upper and lower ranges such that manual adjustment of the separate latch is substantially reduced.

A separate embodiment of the present invention is directed to a method of making a recloseable ring having a latch with a reduced displacement distance necessary to open the recloseable ring without increasing the overall thickness of the recloseable ring, as measured in a radial direction. The method includes providing a first shank portion having a latch end comprising a base and opposing sidewalls which combine to define a cavity configured to receive a head of a latch when the recloseable ring is secured in a closed position, wherein the cavity being configured such that a radial cross section has a generally U-shape comprising two radiused corners each generally located between a separate one of the opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring; providing a second shank portion having a latch end; providing the latch with the larger head, the latch being pivotably mounted on the second shank portion for movement between an open position, in which the latch is detached from the first shank, and a closed position, in which the head is engaged with the first shank, wherein the larger head provides a more secure connection, the latch being configured for release from the first shank portion when a latch end opposite from the latch undergoes a reduced displacement distance, relative to a conventional recloseable ring.

A separate embodiment of the present invention is directed to a method of forming a recloseable ring. The method includes: providing a first shank portion having a latch end and a hinge end, the latch end comprising a base and opposing sidewalls which combine to define a cavity configured to receive a head of a latch when the recloseable ring is secured in a closed position, wherein the cavity being configured such that a radial cross section thereof has a generally U-shape comprising two radiused corners each generally located between a separate one of the opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring; providing a second shank portion having a hinge end and a latch end, wherein the first and second shank portions are formed with a taper proximate the hinge end, without the taper being substantially formed by a manual adjustment process, wherein the taper reduces the instances of pinching by the first and second shank portions during the closing of the ring; aligning the hinge end of the first and second shank portions so that the first and second shank portions combine to form a bore adapted to receive a hinge pin, one of the first and second shank portions defining an opening to the bore, wherein the opening includes a countersink that provides an increased area for receiving a weld; selecting a hinge pin of a sufficient length such that when the hinge pin is initially fully inserted into the bore, an end of the hinge pin protrudes therefrom; inserting the hinge pin into the bore; and laser welding the pin generally to the increased area provided by the countersink such that pin is securely welded to the one of the first and second shank portions defining the opening so that the first and second shank portions are pivotably connected about the hinge pin.

A separate embodiment of the present invention is directed to a method of forming a recloseable ring. The method includes: providing a shank portion having a latch end comprising opposing sidewalls, one of the opposing sidewalls defining an aperture for receiving a latch pin; providing a latch for detachably securing the recloseable ring in a closed position; inserting the latch pin into the aperture and through the latch; and laser welding the latch pin to a portion of the aperture such that the latch is pivotably mounted on the latch pin.

A separate embodiment of the present invention is directed to a method of forming a recloseable ring. The method includes: providing a first shank portion having a latch end and a hinge end, the latch end comprising a base and first opposing sidewalls which combine to define a cavity configured to receive a head of a latch when the recloseable ring is secured in a closed position, wherein the cavity being configured such that a radial cross section has a generally U-shape comprising two radiused corners each generally located between a separate one of the first opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring; providing a second shank portion having a hinge end and a latch end, wherein the first and second shank portions are formed with a taper proximate the hinge end, without the taper being substantially formed by a manual adjustment process, wherein the taper reduces the instances of pinching by the first and second shank portions during the closing of the ring, wherein the latch end of the second shank portion comprises second opposing sidewalls, one of the second opposing sidewalls defining an aperture for receiving a latch pin; providing a latch for detachably securing the recloseable ring in a closed position; inserting the latch pin into the aperture and through the latch; laser welding the latch pin to a portion of the aperture such that the latch is pivotably connected about the latch pin; aligning the hinge end of the first and second shank portions so that the first and second shank portions combine to form a bore adapted to receive a hinge pin, one of the first and second shank portions defining an opening to the bore, wherein the opening includes a countersink that provides an increased area for receiving a weld; inserting the hinge pin into the bore; and laser welding the pin generally to the increased area provided by the countersink such that pin is securely welded to the one of the first and second shank portions defining the opening so that the first and second shank portions are pivotably connected by the hinge pin.

A separate embodiment of the present invention is directed to a method of molding pieces for use in the casting of a recloseable ring. The method includes: providing a mold having a plurality of cavities shaped to form pieces for casting first and second shank portions for a recloseable ring; and forming the pieces for the first and second shank portions simultaneously using the mold.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there are shown in the drawings embodiments which are presently preferred. It is understood, however, that the present invention is not limited to the precise arrangements and instrumentalities shown. In the drawings:

FIG. 1 is a perspective view of a preferred recloseable ring according to the present invention and illustrates first and second shank portions with their respective hinge ends pivotally connected in the bottom part of FIG. 1 and illustrates the latch ends of the first and second shank portions secured in a closed position via a latch;

FIG. 2 is an enlarged partial perspective view of the recloseable ring of FIG. 1 illustrating a tool depressing a free end of the latch to allow the latch ends of the first and second shank portions to be separated;

FIG. 4 also shows the countersink extending approximately around three quarters of a perimeter of the opening to the aperture;

FIG. 8 is a partial perspective view of the recloseable ring of FIG. 1 illustrating the tapered ends of the first and second shank portions proximate to the hinge connection; the tapered ends are substantially formed without any manual adjustments or processing by jewelers due to the use of improved molds;

FIG. 9A is a partial perspective view of a hinge end of a shank portion of a conventional recloseable shank portion illustrating the rough squared off edges that tend to pinch, scratch, or abrade a finger absent significant hand work on the piece by a jeweler;

FIG. 9B is a partial perspective view similar to that of FIG. 9A illustrating the manual filing and polishing necessary to remove the rough edges on the hinge end of the shank portion of the conventional recloseable ring;

FIG. 14 also illustrates a catch which combines with the latch head to prevent separation of the first and second shank portions when the ring is in the closed position with the latch engaged;

DETAILED DESCRIPTION OF THE PREFERRED EMBODIMENT(S)

Figure 3:
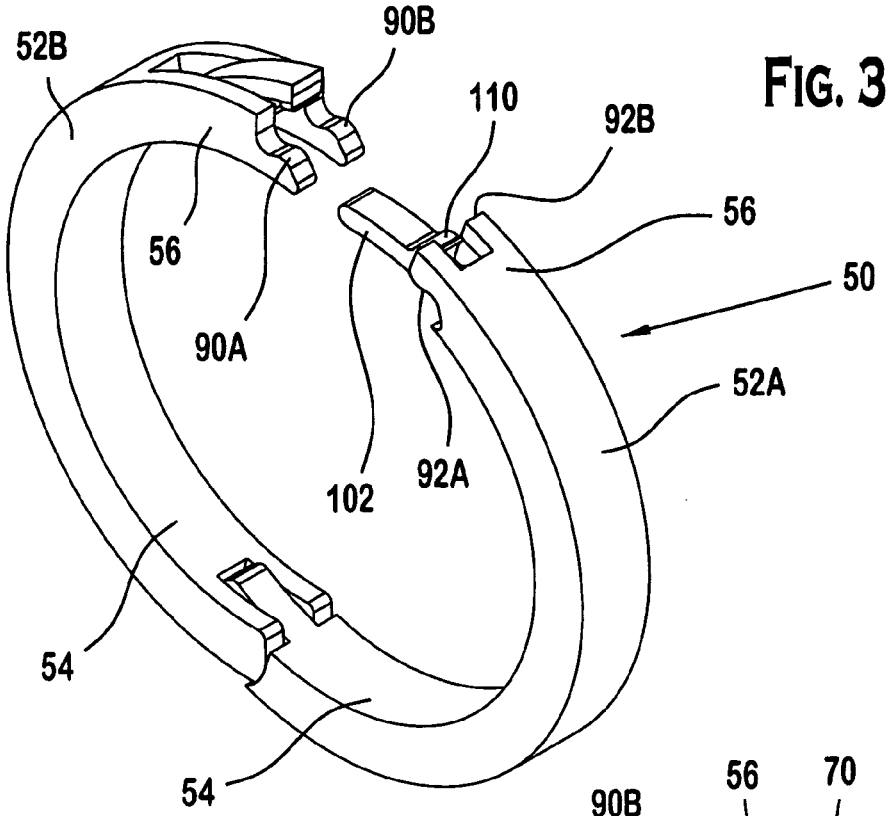
FIG. 3 is a perspective view of the recloseable ring of FIG. 1 and illustrates the latch ends of the first and second shank portions separated.

Certain terminology is used in the following description for convenience only and is not limiting. The words "right," "left," "top", and "bottom" designate directions in the drawings to which reference is made. The words "inwardly" and "outwardly" refer to directions toward and away from, respectively, the geometric center of the recloseable ring of the present invention and designated parts thereof. Additionally, those of ordinary skill in the art will appreciate from this disclosure that the steps recited in any of the methods of the present invention can be performed in any order, unless specifically stated otherwise. Additionally, one or more steps from different methods can be combined without departing from the present invention. Those of ordinary skill in the art will appreciate from this disclosure that while this specification discusses the use of the recloseable rings with fingers, that the present invention includes the use of the recloseable rings of the present invention as toe rings of for placement anywhere else. The words "a" and "one" are defined as including one or more of the referenced item unless specifically stated otherwise. This terminology include the words above specifically mentioned, derivatives thereof, and words of similar import.

Referring to FIGS. 1-5, 7A-8, 10, 11, and 13-17, wherein like numerals indicate like elements throughout, a preferred embodiment of a recloseable ring according to the present invention is shown and designated 50.

The recloseable ring 50 is preferably formed by a durable, attractive material, such as gold. However, those of ordinary skill in the art will appreciate from this disclosure that any suitable material can be used without departing from the present invention.

Referring to FIGS. 1 and 3, the recloseable ring 50 is generally formed by first and second shank portions 52A, 52B and a latch 58. The first and second shank portions 52A, 52B each have a latch end 56 and a hinge end 54. The hinge ends 54 of the first and second shank portions 52A, 52B are hingeably connected. The latch ends 56 of the first and second shank portions 52A, 52B are preferably detachably securable in an interlocked position by ramps (described below) and by the latch 58.

Figure 13:
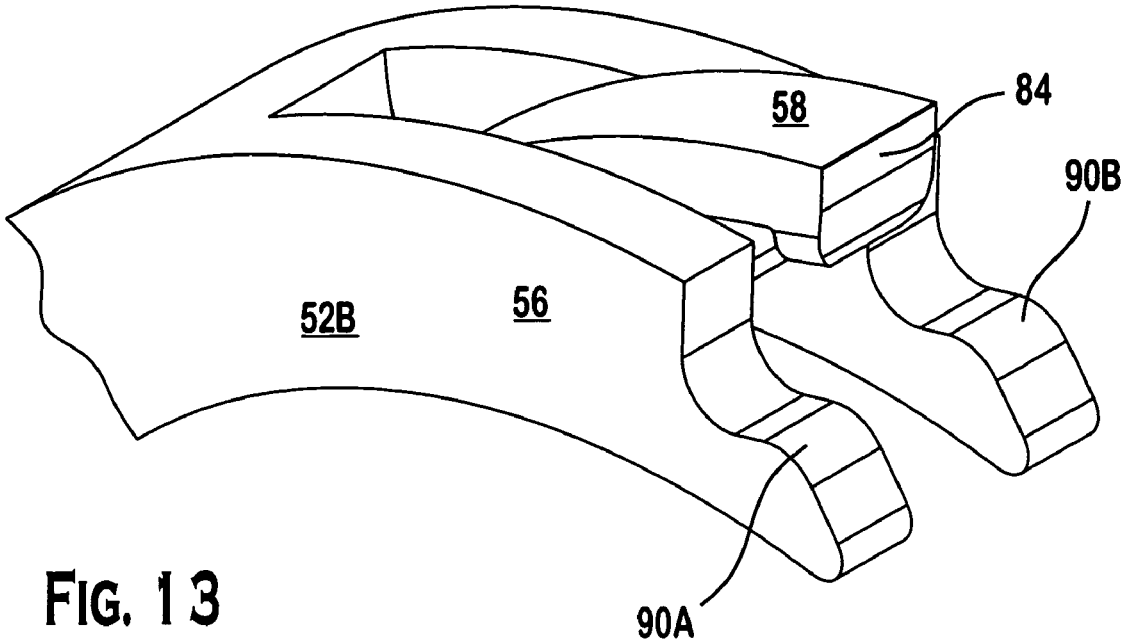
FIG. 13 is an enlarged partial perspective view of the latch end of the second shank portion of the ring of FIG. 1 illustrating first and second inner ramps.
Figure 14:
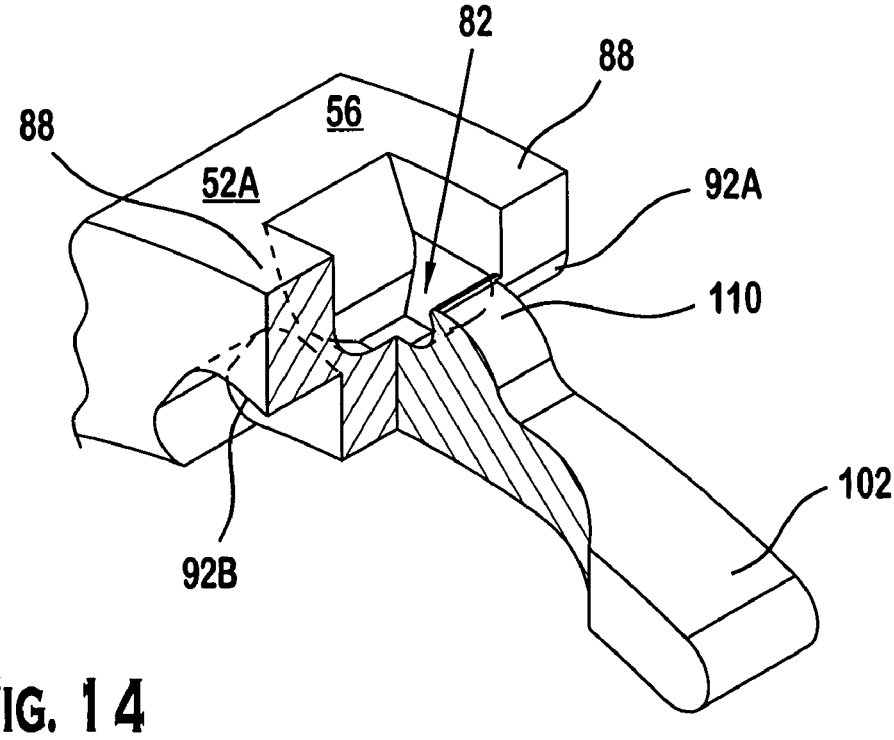
FIG. 14 is a partial broken away perspective view of the latch end of the first shank portion of the ring of FIG. 1 illustrating the cavity for receiving the latch head and illustrating first and second outer ramps.

Referring to FIGS. 3, 13, and 14, the latch ends 56 of the first and second shank portions 52A, 52B each include ramps that are sized to gently interlock the latch ends 56 of the first and second shank portions 52A, 52B. Specifically, the first shank portion 52A includes first and second outer ramps 92A, 92B and the second shank portion 52B includes first and second inner ramps 90A, 90B. While the first and second shank portions 52A, 52B are being closed, an alignment member 102 facilitates alignment of the latch ends 56. When the recloseable ring 50 is closed to bring the latch ends 56 of the first and second shank portions 52A, 52B together, the outwardly facing surfaces of the first and second inner ramps 90A, 90B and the inwardly facing surfaces of the first and second inner ramps 92A, 92B abuttingly contact each other causing the ramps to slightly deform and then, interlock with each other.

Figure 10:
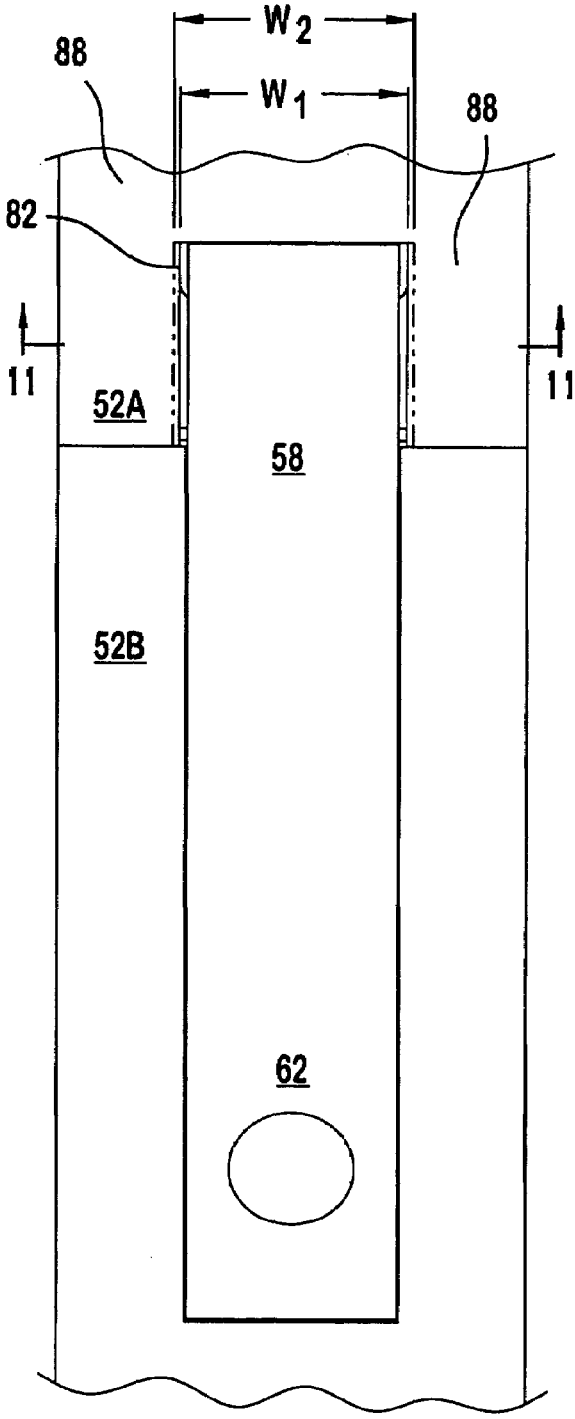
FIG. 10 is a top plan view of the ring of FIG. 1 and illustrates the reduction in gap between the latch and shank portions from width W2 (the prior art width) to width W1 (the width of the recloseable ring of the present invention)
Figure 11:
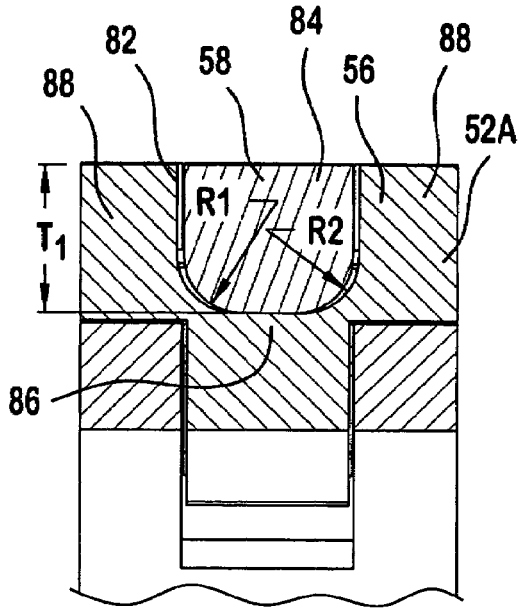
FIG. 11 is a radial cross-sectional view through the latch end of the first shank portion of the recloseable ring of FIG. 1 and illustrates the radiused corners of a cavity that receives a head of the latch, the reduced thickness of the connection between the base and the opposing side walls forming the cavity (relative to that shown in FIG. 12) is made possible by the radiused corners which increase the amount of stress that can be withstood by the cavity base prior to separation of the cavity base from the cavity's opposing walls.
Figure 15:
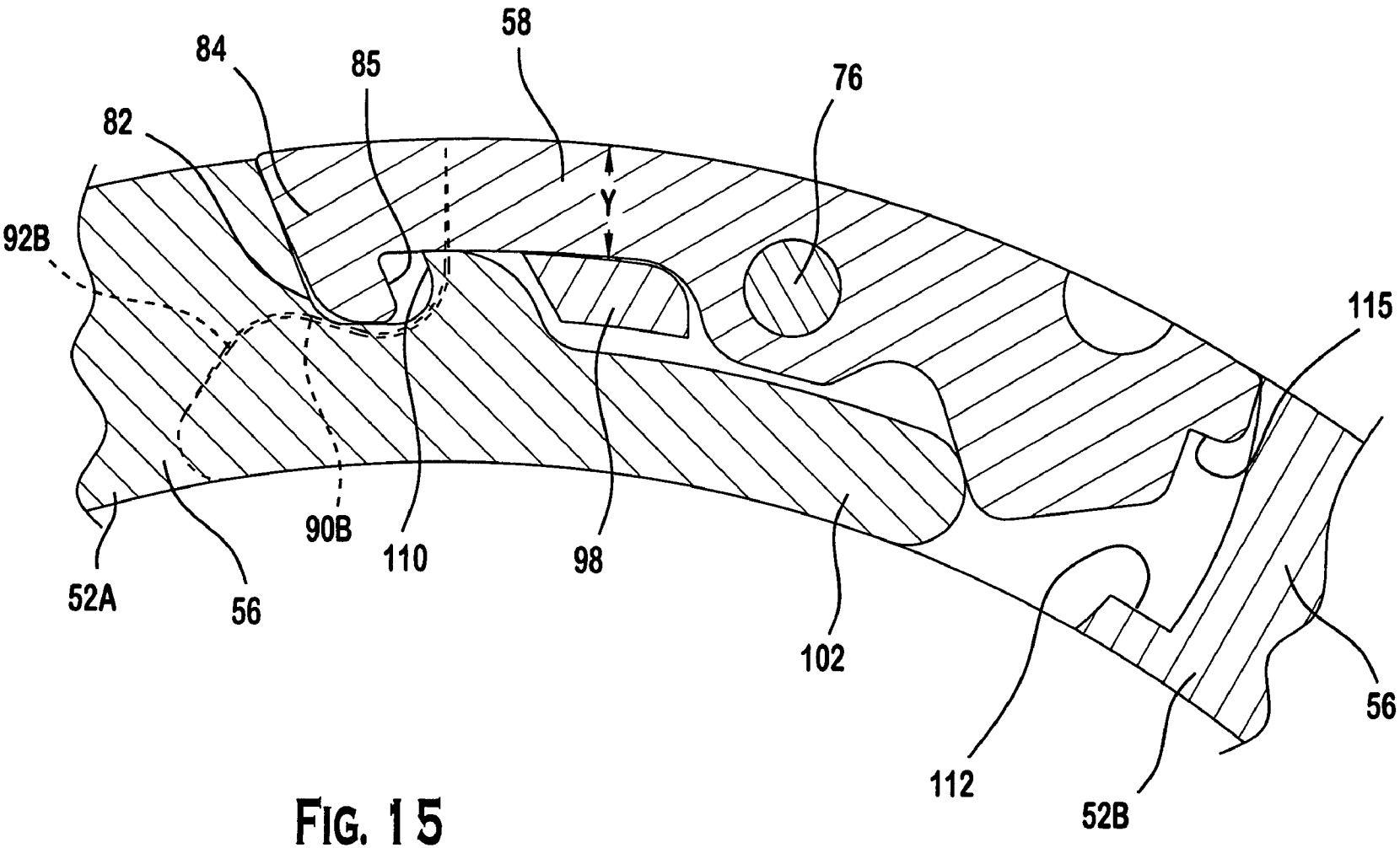
FIG. 15 is an enlarged partial cross-sectional view of the ring of FIG. 1 illustrating a preferred profile of the latch of the ring of FIG. 1; the improved profile of the ring increases the cam action caused by depression of the free end of the latch which reduces the distance that the free end of the latch must be depressed to disengage the latch from the cavity.

To further secure the first and second shank portions 52A, 52B together, once the latch ends 56 are engaged, the latch 58 is moved into a closed position (shown in FIGS. 1, 10, and 11). Referring to FIG. 15, when the latch 58 is in the closed position, a latch head 84 prevents the first and second shank portions 52A, 52B from being pulled apart. If the first and second shank portions 52A, 52B are pulled apart while the latch 58 is in the closed position, the latch head 84 moves into contact with a catch 110 to prevent separation. The catch 110 is located on the alignment member 102. The latch head 84 includes a hook portion 85 (shown in FIG. 15).

Referring to FIG. 2, to remove the ring 50, a tool 60 is used to depress a free end 62 of the latch 58 to disengage the latch head 84 from the cavity 82 in the first shank portion 52A. A free end 62 of the latch 56 includes a stop 112 that is configured to abut shoulder 115 when the latch 56 is rotated a predetermined distance to prevent the latch 56 from over opening during removal of the ring 50. Then, the first and second inner ramps 90A, 90B and the first and second outer ramps 92A, 92B are separated by pulling the latch ends 56 of the first and second shank portion 52A, 52B generally away from each other.

Referring to FIGS. 7D-7G, a preferred method of forming the recloseable ring includes providing first and second shank portions 52A, 52B. Each of the first and second shank portions 52A, 52B have a hinge end 54 and a latch end 56. The hinge end 54 of the first and second shank portions 52A, 52B are aligned so that the first and second shank portions 52A, 52B combine to form a bore 64 adapted to receive the hinge pin 66. One of the first and second shank portions 52A, 52B defines an opening 68 to the bore 64.

The present invention includes inserting the hinge pin 66 into the bore 64. It is preferred that the hinge pin 66 protrudes from each side of the recloseable ring 50 prior to the securing of the hinge pin 66 therein. The hinge pin 66 is welded to a portion of the bore 64 using laser 108 such that the first and second shank portions 52A, 52B are pivotally connected about the hinge end 54 thereof.

Figure 4:
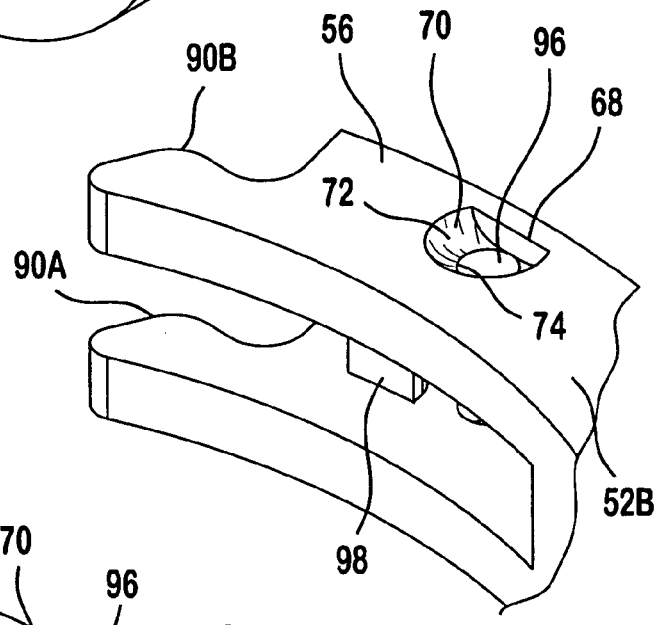
FIG. 4 is an enlarged partial perspective view of the latch end of the second shank portion of the ring of FIG. 1 and illustrates an aperture adapted to receive a latch pin, an opening to the aperture comprises a countersink that provides an increased area for a weld between the second shank portion and the latch pin.
Figure 5:
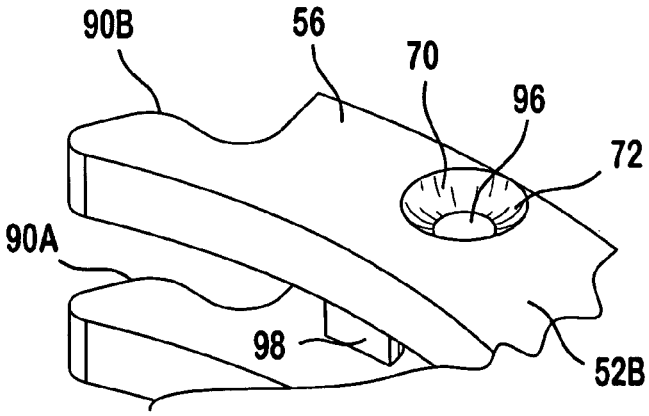
FIG. 5 is a perspective partial view of the ring of FIG. 1 (similar to that of FIG. 4) and illustrates the countersink extending around the entire perimeter of the opening to the aperture.
Figure 6A:
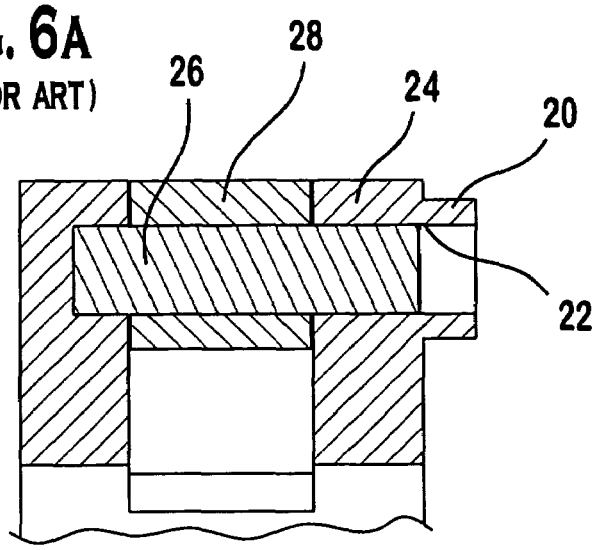
FIG. 6A (PRIOR ART)
FIG. 6A is a radial cross-sectional view through a latch pin of a recloseable ring during assembly and illustrates a mound of metal 20 that surrounds a latch pin hole 22 prior to completion of the assembly process.
Figure 6B:
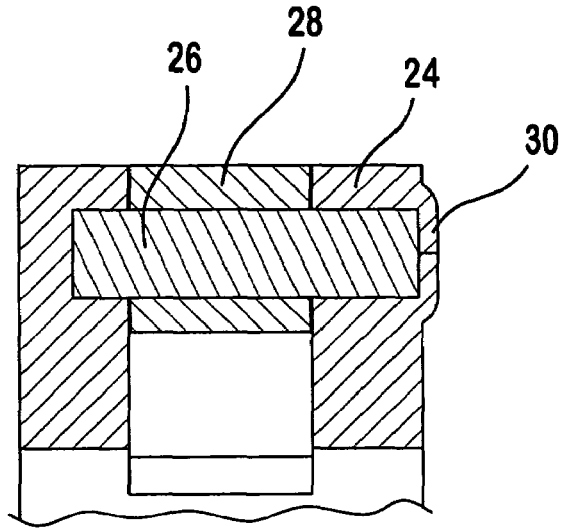
FIG. 6B (PRIOR ART)
FIG. 6B is a radial cross-sectional view of the conventional recloseable ring of FIG. 6A after the mound of metal has been pressed over the pin to attempt to hold the latch pin in position.
Figure 6C:
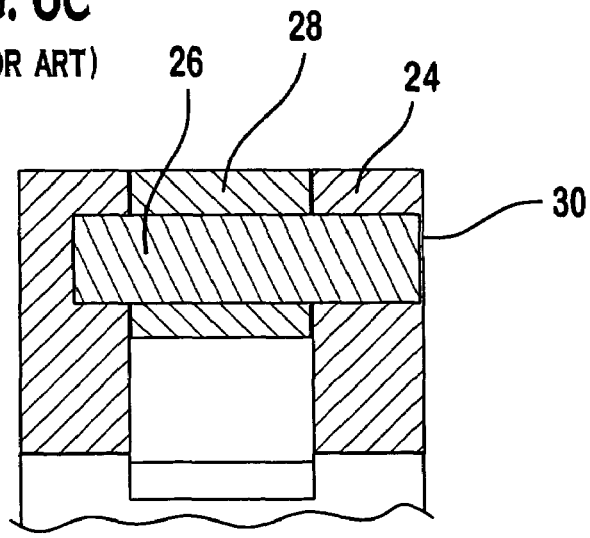
FIG. 6C (PRIOR ART)
FIG. 6C is a radial cross-sectional view through the latch pin of a conventional recloseable ring of FIG. 6B illustrating how only a thin layer of metal is often present over the latch pin after the shank portion has been polished.

Referring to FIGS. 4 and 5, the latch end 56 of the second shank portion 52B is shown prior to insertion of the latch 58 and the latch pin 76 are inserted therein. A crossbar 98 may be used to provide stability to the latch end 56 of the second shank portion 52B. It is preferred, but not necessary, that the characteristics of the countersink 70 are generally the same as the countersinks used on the hinge end 54 of the first and second shank portions 52A, 52B. It is preferred that the opening 68 to the aperture 96 includes a countersink 70 that provides an increased area 72 for a weld to be formed by the laser welding.

It is preferred that the countersink 70 generally extend about the opening 68 of the aperture 96 through generally three quarters of a perimeter 74 of the opening 68. It is preferred that the laser welding includes welding the latch pin 76 to the aperture 96 generally along the increased area 72 such that the end of the latch pin 76 that protrudes from the aperture 96 is melted and generally fills the countersink 70. It is preferred, but not necessary that the latch pin 76 include an enlarged portion that overlies a portion of the countersink 70 prior to welding. This reduces the amount of the latch pin 76 that needs to be melted to fill the countersink 70 while providing additional surface area over which to weld the latch pin 76 to the second shank portion 52B.

Laser welding the end of the latch pin 76 preferably includes the end of the latch pin 76 being generally flush with an outer surface of the second shank portion 52B that defines the opening 68 after the laser welding is completed.

Figure 12:
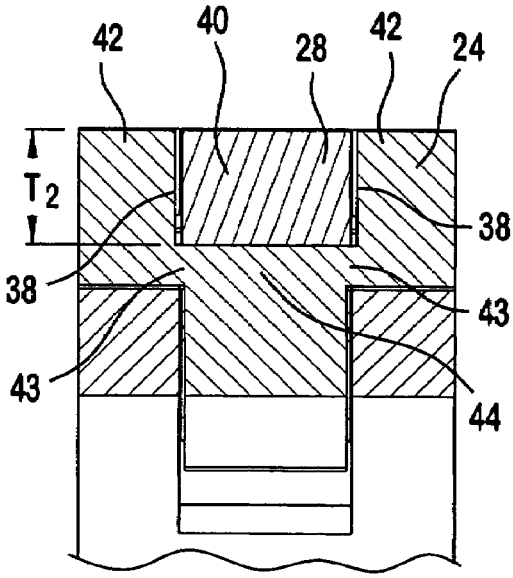
FIG. 12 (PRIOR ART)
FIG. 12 is a radial cross-sectional view through a latch end of a shank portion of a conventional recloseable ring of the prior art illustrating the thick connection (relative to that of FIG. 11) necessary between the base and opposing side walls of the cavity to prevent separation of the base from the walls during use.

Another preferred method of making the recloseable ring 50 of the present invention results in a recloseable ring 50 that has a thicker latch 58 (as measured radially) than conventional recloseable rings without having to increase an overall thickness of the recloseable ring. Referring to FIGS. 11 and 12, a thickness "$T_1$" (measured in the radial direction) through the latch head 84 is increased without a corresponding increase in the thickness of the overall ring. The increase in thickness in the latch head 84 does not necessarily require that the length of the hook portion 85 be increased relative to conventional recloseable rings. When the latch head 84 is increased in thickness it is possible to make the portion of the latch 58 that overlies the cross bar 98 (i.e., the portion of the latch 58 that overlies the crossbar 98 when the latch 58 is closed as shown in FIG. 15). The thickening of this portion of the latch 58 strengthens the latch 58. Conventional recloseable rings have a latch head thickness "$T_2$" of zero point zero three eight (0.038 in.) inches. One preferred embodiment of the present invention has a latch head thickness "$T_1$" greater than zero point zero three eight (0.038 in.) inches. More preferably, the thickness "$T_1$" of the latch head 84 is generally between approximately zero point zero four (0.04 in.) and zero point zero five (0.05 in.) inches. Most preferably, the thickness "$T_1$" of the latch head 84 is approximately zero point zero four seven (0.047 in.) inches.

The method includes providing a shank portion having a latch end 56 comprising a base 86 and opposing side walls 88. The base 86 and opposing side walls 88 combine to define a cavity 82 configured to receive a head 84 of the latch 58 when the recloseable ring 50 is secured in a closed position. The cavity 82 is preferably configured such that a radial cross section has a generally U-shape (shown in FIG. 11) comprising two radiused corners R1, R2. Each of the radiused corners R1, R2 is generally located between a separate one of the opposing walls 88 and the base 86. The radiused corners R1, R2 preferably have a radius of curvature of between approximately eight thousandths (0.008 in.) of an inch and approximately fifteen thousands (0.015 in.) of an inch. More preferably the radiused corners R1, R2 have a radius of curvature of approximately one hundredth (0.01 in.) of an inch.

The radiused corners R1, R2 add strength to the base 86 that allows the base 86 to be thinner and the cavity 82 to be deeper, relative to conventional recloseable rings (which only allow latch heads of a thickness of zero point zero three eight (0.038 in.) inches to be inserted therein), to allow the latch head 84 of the recloseable ring 50 of the present invention to be larger, relative to conventional recloseable rings, without increasing the overall radial thickness of the recloseable ring. Referring to FIG. 15, the thicker latch head 84 allows the portion of the latch 58 that overlies the crossbar 98 to be thicker, as measured along thickness "Y". This strengthens the latch 58.

Conventional recloseable rings have a cavity base thickness, as measured in the radial direction, of approximately four hundredths (0.04 in.) of an inch. It is preferred that the base 86 of the recloseable ring 50 have a thickness, as measured in the radial direction of less than four hundredths (0.04 in.) of an inch. It is more preferred that the base 86 of the recloseable ring 50 have a thickness, as measured in the radial direction of less than thirty-five thousandths (0.035 in.) of an inch. It is most preferred that the base 86 of the recloseable ring 50 have a thickness, as measured in the radial direction of less than thirty-one thousandths (0.031 in.) of an inch.

Referring to FIG. 10, it is preferred, but not necessary, that the method also include forming the first and second shank portions to eliminate any gap between opposing walls 88 of the cavity 82 and a latch 58 that is received therein. The difference between the widths W2 and W1 between the opposing walls 88 shows the reduction in distance generally necessary to generally eliminate the gap between the opposing walls and the latch 58. The width W2 illustrates the distance between opposing side walls in a conventional recloseable ring. W2 is zero point zero fiver four (0.054 in.) inches. The recloseable ring 50 of the present invention has reduced the distance between opposing walls 88 to widths W1. It is preferred that W1 is approximately zero point zero five (0.05 in.) inches.

Another method of forming a recloseable ring 50 according to the present invention is shown in FIG. 8 and includes the step of forming the hinge ends 54 of the first and second shank portions 52A, 52B with a taper 80 formed proximate to the hinge ends 54. The taper 80 is substantially formed without any manual adjustment processes. It is preferred that the taper 80 is provided by improving the mold used to mold the piece that is cast into the shank portions. The tapered corners 80 of the first and second shank portions 52A, 52B reduce the instances of pinching of the first and second shank portions 52A, 52B during the closing of the ring. While a preferred taper 80 is shown, those of ordinary skill in the art will appreciate that any suitable shaped tapered corners 80 that reduce pinching and scratching can be used without departing from the scope of the present invention.

Figure 16:
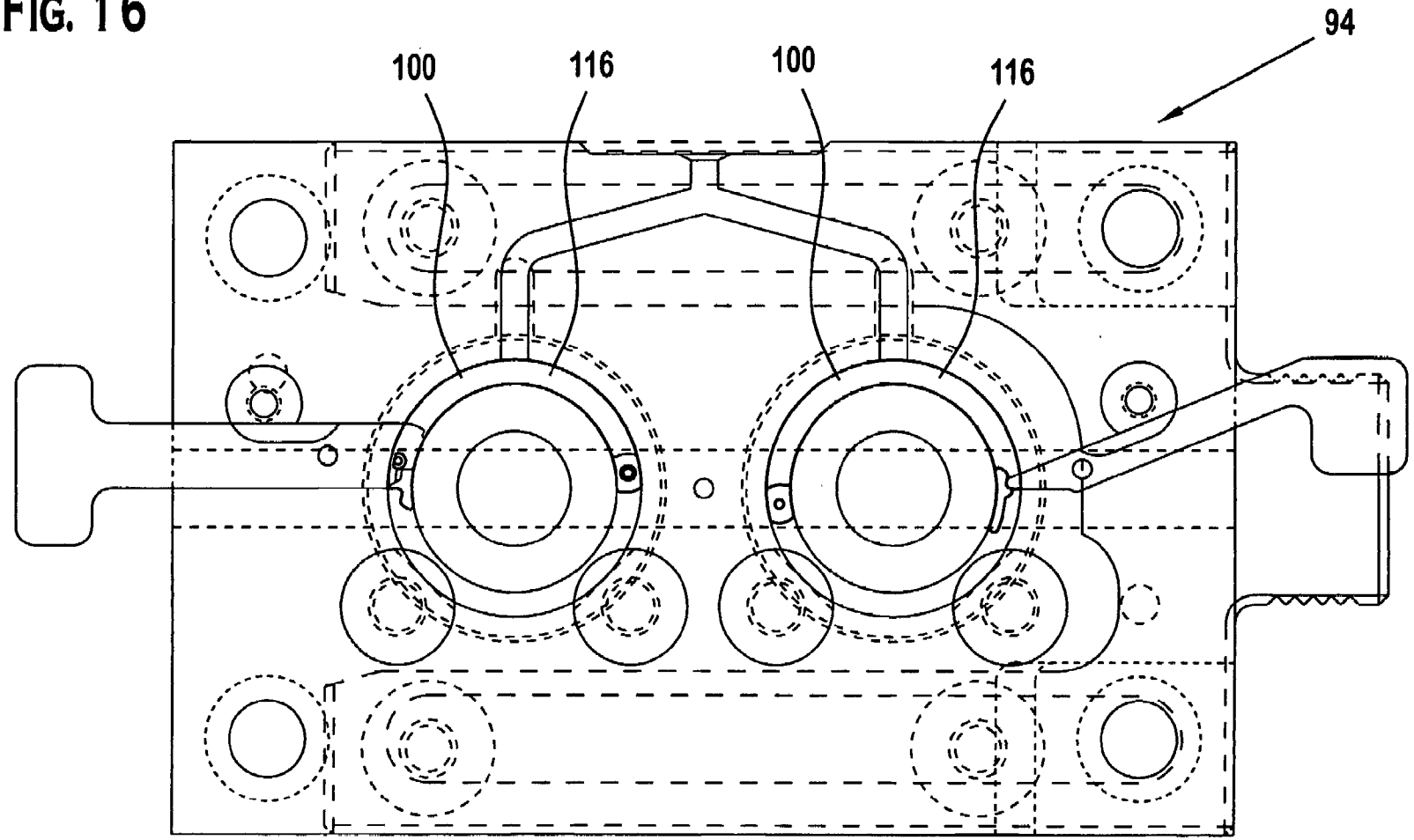
FIG. 16 is a top plan view of a bottom plate of a mold for simultaneously manufacturing ring component pieces for the first and second shank portions of the ring of FIG. 1.

Referring to FIG. 16, another method of the present invention includes a method of molding pieces for use in the casting of recloseable rings 50. The method includes providing a mold 94 having a plurality of cavities 100 shaped for forming pieces for casting first and second shank portions 52A, 52B for the recloseable ring 50. The pieces for the first and second shank portions 52A, 52B are formed simultaneously using the mold 94.

The method preferably includes injecting a material into the plurality of cavities 100 and allowing the material to cure to form the pieces corresponding to the first and second shank portions 52A, 52B. The material is preferably a plastic suitable for use in both an injection molding process and a subsequent casting process. However, those of ordinary skill in the art will appreciate from this disclosure that any suitable wax or polymer can be used without departing from the scope of the present invention. The pieces are preferably used to cast the first and second shank portions 52A, 52B.

Figure 17:
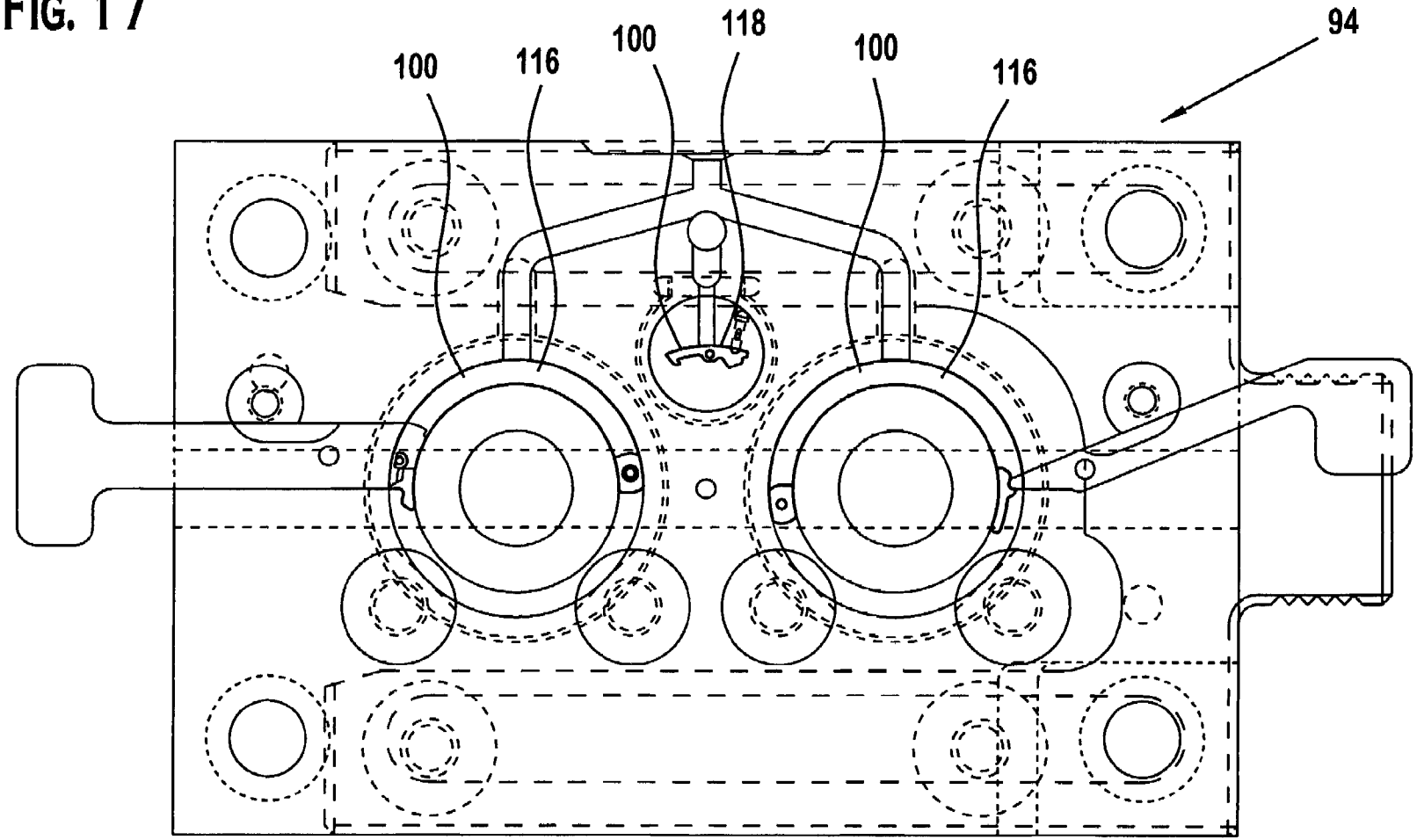
FIG. 17 is a top plan view of the bottom mold piece for simultaneously manufacturing ring component pieces for first and second shank portions and the latch of the ring of FIG. 1.

Referring to FIG. 17, the mold may include cavities shaped to form a piece for a latch for the recloseable ring 50. It is preferable that the pieces for the first and second shank portions 52A, 52B and the latch 58 are formed simultaneously using the mold 94. It is preferred that a separate one of the molds is prepared for each ring size with each of the molds sized to compensate for shrinkage of the pieces. By designing a mold to construct all of the major components of the recloseable ring 50 simultaneously, any shrinkage in the resulting pieces used during the casting process is uniform. This results in a better alignment between the various components of the recloseable ring 50.

Another method of the present invention includes providing coordinated latches for various ring sizes for a recloseable ring 50 of a given thickness (i.e., width). The method includes dividing a given range of recloseable ring sizes into upper and lower ranges and providing a separate latch for each of the upper and lower ranges such that manual adjustment of the latches is substantially reduced. It is preferred that the upper range for recloseable ring sizes is between six point five (6.5) and eleven point five (11.5) and that the lower range for recloseable ring sizes is between two point five (2.5) and five point five (5.5).

Figure 7A:
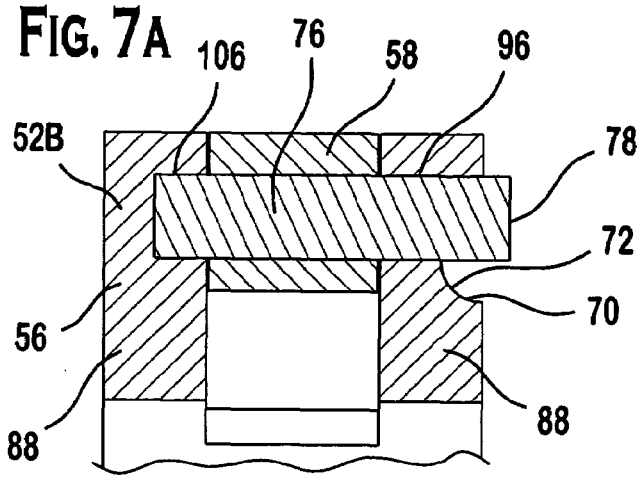
FIG. 7A is a radial cross-sectional view through a latch pin of the ring of FIG. 1 during assembly and illustrates an end of the latch pin protruding from the opening in the aperture.
Figure 7B:
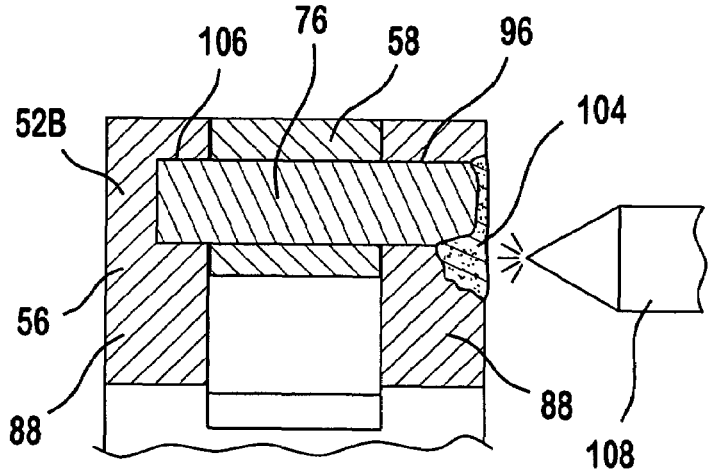
FIG. 7B is a radial cross-sectional view similar to that of FIG. 7A illustrating the use of a laser to melt the protruding end of the latch pin to create a weld between the increased area of the countersink and the latch pin.
Figure 7C:
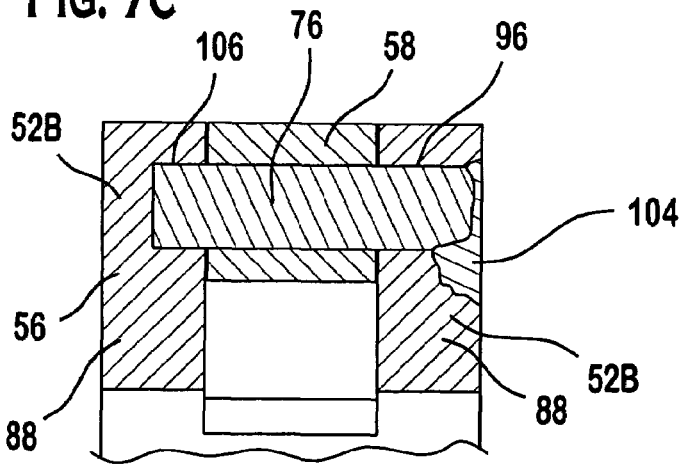
FIG. 7C is a radial cross-sectional view similar to that of FIG. 7B and illustrates the completion of the latch pin insertion process with the outer surface of the second shank portion polished smooth.
Figure 7D:
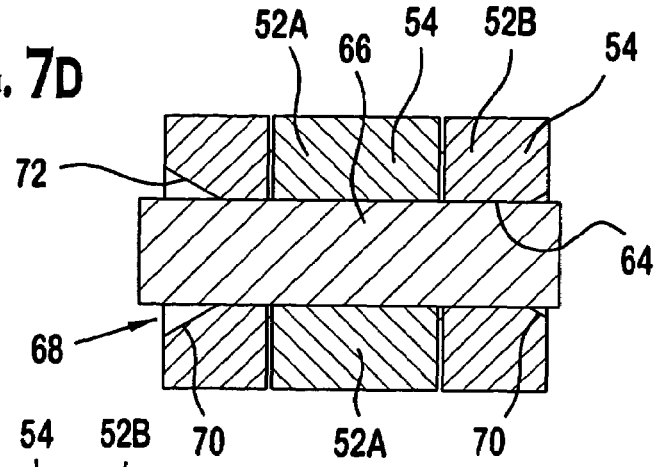
FIG. 7D is a radial cross-sectional view through a hinge pin of the ring of FIG. 1 during assembly illustrating the hinge pin extending through a bore and protruding therefrom on both sides prior to the completion of the assembly process.
Figure 7E:
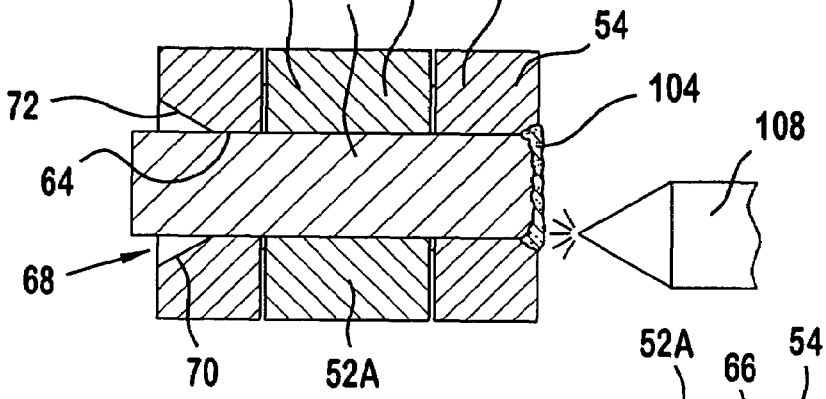
FIG. 7E is a radial cross-sectional view similar to that of FIG. 7D illustrating one side of the hinge pin lasered to form a weld with the increased area provided by the countersink.
Figure 7F:
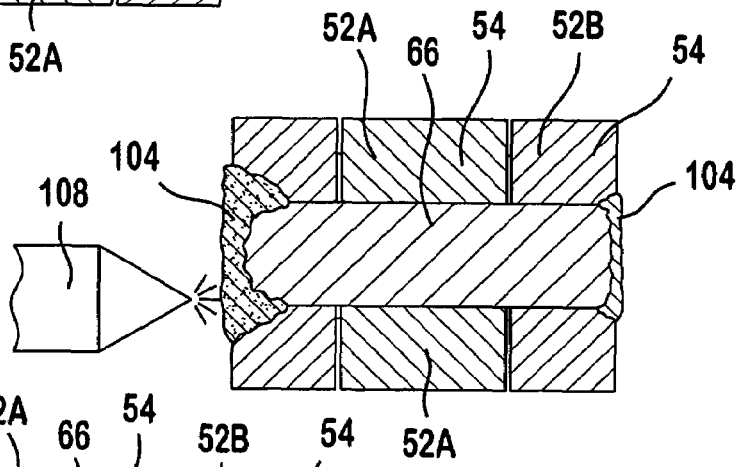
FIG. 7F is a radial cross-sectional view similar to that of FIG. 7E illustrating the remaining free end of the hinge pin being laser welded to form a second weld between the hinge pin and second countersink.
Figure 7G:
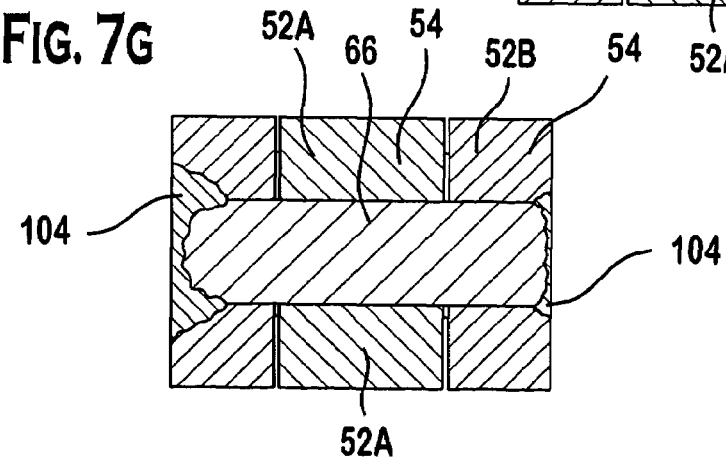
FIG. 7G is a radial cross-sectional view similar to that of FIG. 7F illustrating the completion of the hinge pin insertion process with the outer surface of the second shank portion polished smooth.
Figure 9C:
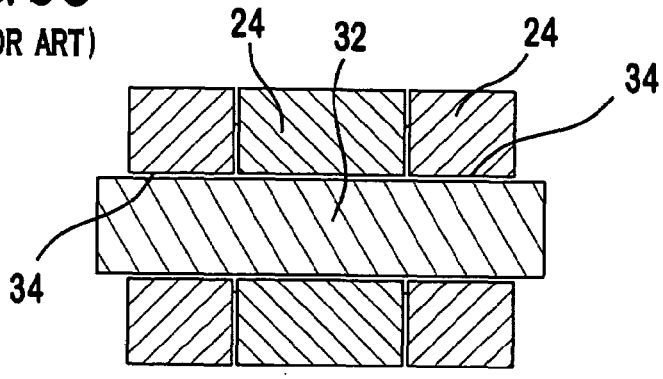
FIG. 9C (PRIOR ART)
FIG. 9C is a radial cross-sectional view through a hinge pin of a conventional recloseable ring illustrating the initial placement of the hinge pin through the shank portions.
Figure 9D:
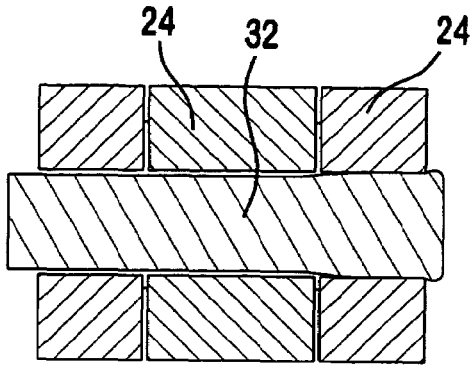
FIG. 9D (PRIOR ART)
FIG. 9D is a radial cross-sectional view similar to that of FIG. 9C illustrating one side of the hinge pin of a conventional recloseable ring after operation of a rivet machine thereon.
Figure 9E:
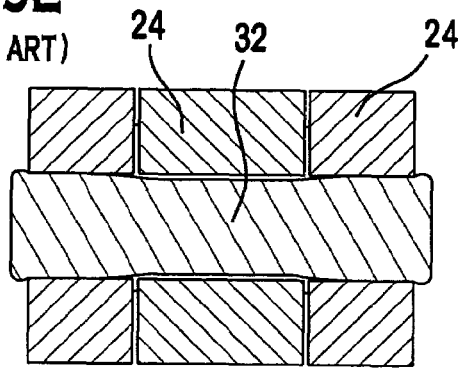
FIG. 9E (PRIOR ART)
FIG. 9E is a radial cross-sectional view similar to that of FIG. 9D illustrating the hinge pin of a conventional recloseable ring after the rivet machine has been used on the remaining side of the shank.
Figure 9F:
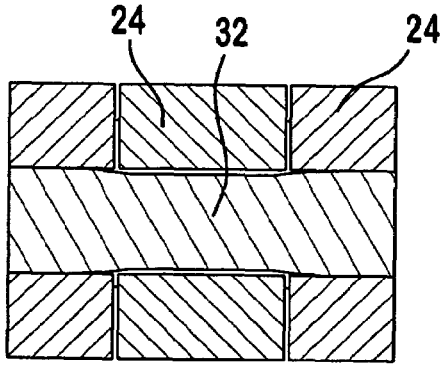
FIG. 9F (PRIOR ART)
FIG. 9F is a radial cross-sectional view similar to that of FIG. 9E illustrating the shank portion of a conventional recloseable ring after polishing.

Referring to FIGS. 7A-7C, another method of the present invention preferably includes providing a shank portion having a latch end 56 comprising opposing side walls 88. One of the opposing side walls 88 defines an aperture 96 for receiving a latch pin 76. A latch 58 is provided for detachably securing the recloseable ring 50 in a closed position. The latch pin 74 is inserted into the aperture 96 and through the latch 58. The latch pin 74 is laser welded to a portion of the aperture 96 such that the latch 58 is pivotally mounted on the latch pin 76. It is preferred that the latch pin 76 is of a sufficient length that when the hinge pin 56 is initially fully inserted into the aperture 96, an end of the latch pin 76 protrudes therefrom.

It is recognized by those skilled in the art that changes may be made to the above described embodiments of the invention without departing from the broad inventive concept thereof. For example, while the manufacturing of the recloseable ring is described as being produced using an injection molding process and a casting process, any suitable method of manufacture can be used. Accordingly the recloseable ring 50 can be manufactured using machining, CNC machinery, Steriolithography, or any other known means. Alternatively, the recloseable ring can be produced by hand without departing from the scope of the present invention. It is understood, therefore, that this invention is not limited to the particular embodiments disclosed, but is intended to cover all modifications which are in within the spirit and scope of the invention as described by the above specification; as defined by the appended claims; and/or as shown in the attached drawings.

We claim:

1. A method of making a recloseable ring having a latch with a reduced displacement distance necessary to open the recloseable ring without increasing the overall thickness of the recloseable ring, as measured in a radial direction, comprising:

providing a first shank portion having a latch end comprising a base and opposing sidewalls which combine to define a cavity configured to receive a head of a latch when the recloseable ring is secured in a closed position, wherein the cavity being configured such that a radial cross section has a generally U-shape comprising two radiused corners each generally located between a separate one of the opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring;

providing a second shank portion having a latch end;

providing the latch with the larger head, the latch being pivotably mounted on the second shank portion for movement between an open position, in which the latch is detached from the first shank, and a closed position, in which the head is engaged with the first shank, wherein the larger head provides a more secure connection, the latch being configured for release from the first shank portion when a latch end opposite from the latch undergoes a reduced displacement distance, relative to a conventional recloseable ring.

2. The method of claim 1, wherein the step of providing the latch further comprises the reduced displacement distance being less than approximately one and one half (1½ mm.) millimeters.

3. The method of claim 1, wherein the step of providing the latch further comprises the reduced displacement distance being less than approximately one half (½ mm.) of a millimeter.

4. The method of claim 1, wherein the step of providing the latch further comprises the reduced displacement distance being less than approximately two tenths (0.2 mm.) of a millimeter.

5. A method of forming a recloseable ring, comprising:

providing a first shank portion having a latch end and a hinge end, the latch end comprising a base and opposing sidewalls which combine to define a cavity configured to receive a head of a latch when the recloseable ring is secured in a closed position, wherein the cavity being configured such that a radial cross section thereof has a generally U-shape comprising two radiused corners each generally located between a separate one of the opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring;

providing a second shank portion having a hinge end and a latch end, wherein the first and second shank portions are formed with a taper proximate the hinge end, without the taper being substantially formed by a manual adjustment process, wherein the taper reduces the instances of pinching by the first and second shank portions during the closing of the ring;

aligning the hinge end of the first and second shank portions so that the first and second shank portions combine to form a bore adapted to receive a hinge pin, one of the first and second shank portions defining an opening to the bore, wherein the opening includes a countersink that provides an increased area for receiving a weld;

selecting a hinge pin of a sufficient length such that when the hinge pin is initially fully inserted into the bore, an end of the hinge pin protrudes therefrom;

inserting the hinge pin into the bore; and laser welding the pin generally to the increased area provided by the countersink such that the pin is securely welded to the one of the first and second shank portions defining the opening so that the first and second shank portions are pivotably connected about the hinge pin.

6. The method of claim 5, wherein the step of aligning further comprises the opening to the bore comprising a countersink extending along generally about three quarters of a perimeter of the opening.

7. The method of claim 6, wherein the step of laser welding comprises laser welding the hinge pin to the bore generally along the increased area such that the end of the hinge pin that protrudes from the is melted and generally fills the countersink.

8. The method of claim 7, wherein the step of laser welding further comprises the end of the hinge pin being generally flush with an outer surface of the one of the first and second shank portions that defines the opening after laser welding is completed.

9. The method of claim 8, further comprising forming the first and second shank portions to eliminate any gap between opposing walls of the cavity and the latch that is received therein.

10. The method of claim 5, wherein the step of providing a shank portion comprises providing a shank portion having a base having a thickness, as measured in a radial direction of between approximately four hundredths (0.04 in.) of an inch and approximately two hundredths (0.02 in.) of an inch.

11. The method of claim 10, wherein the step of providing a shank portion comprises providing a shank portion having a base having a thickness, as measured in a radial direction of approximately three hundredths (0.03 in.) of an inch.

12. The method of claim 5, further comprising engaging the head of the latch with the cavity, wherein the head has a thickness, as measured in a radial direction, greater than approximately zero point zero three eight (0.038 in.) inches.

13. The method of claim 12, further comprising engaging the head of the latch with the cavity, wherein the head has a thickness, as measured in a radial direction, greater than approximately zero point four (0.04 in.) inches.

14. The method of claim 13, further comprising engaging the head of the latch with the cavity, wherein the head has a thickness, as measured in a radial direction, greater than approximately zero point zero four five (0.045 in.) inches.

15. The method of claim 13, further comprising engaging the head of the latch with the cavity, wherein the head has a thickness, as measured in a radial direction, of approximately zero point zero four seven (0.047 in.) inches.

16. A method of forming a recloseable ring, comprising:

providing a first shank portion having a latch end and a hinge end, the latch end comprising a base and first opposing sidewalls which combine to define a cavity configured to receive a head of a latch when the recloseable ring is secured in a closed position, wherein the cavity being configured such that a radial cross section has a generally U-shape comprising two radiused corners each generally located between a separate one of the first opposing walls and the base, the radiused corners adding strength to the base that allows the base to be thinner and the cavity to be deeper, relative to conventional recloseable rings, to allow for the head to be larger, relative to conventional recloseable rings, without increasing the overall radial thickness of the recloseable ring;

providing a second shank portion having a hinge end and a latch end, wherein the first and second shank portions are formed with a taper proximate the hinge end, without the taper being substantially formed by a manual adjustment process, wherein the taper reduces the instances of pinching by the first and second shank portions during the closing of the ring, wherein the latch end of the second shank portion comprises second opposing sidewalls, one of the second opposing sidewalls defining an aperture for receiving a latch pin;

providing a latch for detachably securing the recloseable ring in a closed position;

inserting the latch pin into the aperture and through the latch;

laser welding the latch pin to a portion of the aperture such that the latch is pivotably connected about the latch pin;

aligning the hinge end of the first and second shank portions so that the first and second shank portions combine to form a bore adapted to receive a hinge pin, one of the first and second shank portions defining an opening to the bore, wherein the opening includes a countersink that provides an increased area for receiving a weld;

inserting the hinge pin into the bore; and laser welding the pin generally to the increased area provided by the countersink such that the pin is securely welded to the one of the first and second shank portions defining the opening so that the first and second shank portions are pivotably connected by the hinge pin.

* * * * *